United States Patent [19]

Donisi

[11] 4,387,749

[45] Jun. 14, 1983

[54] FILLER SLEEVE FOR USE IN CONJUNCTION WITH A BAG ADAPTED TO CONTAIN A GRANULAR PRODUCT

[75] Inventor: Frederick A. Donisi, Trenton, Ohio

[73] Assignee: Champion International Corporation, Stamford, Conn.

[21] Appl. No.: 300,038

[22] Filed: Sep. 8, 1981

[51] Int. Cl.[3] ..... B65B 1/04

[52] U.S. Cl. ..... 141/68; 137/846; 150/9; 229/62.5

[58] Field of Search ..... 141/313–317, 141/114, 67, 68, 10; 137/846; 229/62.5; 150/9

[56] References Cited

U.S. PATENT DOCUMENTS 3,517,682 6/1970 Smith ..... 137/846

4,091,986 5/1978 Eberle ..... 229/62.5

*Primary Examiner*—Houston S. Bell, Jr.

*Attorney, Agent, or Firm*—Evelyn M. Sommer

[57] ABSTRACT

A filler sleeve is disclosed for use in conjunction with a bag adapted to contain a powder, fibrous, flake or granular product. More specifically, a filler sleeve is disclosed comprised of an elongated tubular member which is connected to the top end of the bag. The tubular member includes an open end which is contiguous with a filler opening provided in the top end of the bag. The opposed end of the tubular member is heat sealed or locked by folding. A longitudinally extending slit is provided in the tubular member disposed on the bottom surface thereof. In use, when the bag is filled by introducing the product by air flow or by gravity, through a filler nozzle which is inserted into the filler opening and into the tubular member, the product is deflected downwardly into the bag thereby inhibiting the likelihood of blowout of the side panels. Preferably, the tubular member is formed from a stretchable material such as polyethylene, so that during the filling of the bag the flow of the product stretches the material. By this arrangement, when the filling is completed, and the bag is inverted, the side edges of the slit, which have been stretched, overlap and the weight of the product functions to maintain the overlapping relationship thereby preventing the unwanted escape of the product from the bag.

14 Claims, 7 Drawing Figures

FILLER SLEEVE FOR USE IN CONJUNCTION WITH A BAG ADAPTED TO CONTAIN A GRANULAR PRODUCT

BACKGROUND OF THE INVENTION

The subject invention relates to a new and improved filler sleeve for use in conjunction with a bag for containing a powder, fibrous, flake or granular product.

During the pressurized filling of the bag the opening in the filler sleeve of the subject invention functions to permit the product to be deflected downwardly into the bag thereby reducing the likelihood of end panel blowouts. Further, the filler sleeve is operative to prevent unwanted escape of the product from the bag after filling.

In the prior art, various bags have been produced for holding powdered, fibrous, flake or granulated products which are adapted to be filled automatically. These prior art bags generally have an elongated tubular configuration, including opposed top and bottom ends. The bottom end of the bag was closed and the top end included a filler opening, adjacent one of the side edges of the bag.

Some of the prior art bags included an elongated tubular filler sleeve having opposed open ends. The sleeve would be connected to the top end of the bag with one open end thereof being contiguous with the filler opening, formed in one side panel of the bag. The opposed open end of the sleeve would terminate adjacent the opposed side panel of the bag. During a filling operation, the product would be injected under pressure, through a nozzle inserted through the filler opening of the bag. The product would then pass through the filler sleeve entering the bag through the opposed open end of the sleeve. While this construction enabled the relatively rapid, pollution free filling of the bag, unless the filling pressure was carefully regulated, the force of the product coming through the open end of the tubular sleeve would occasionally rupture the adjacent side wall panel of the bag. As can be appreciated, every occurrence of a "blowout" would substantially slow the automatic filling operations. Accordingly, it would be desirable to provide an improved filler sleeve which substantially reduces the likelihood of end panel blowout.

The prior art bags were designed such that additional sealing of the bag after the filling operation was complete was unnecessary. More particularly, after the filling operation was completed, the bag was inverted such that the weight of the product would rest on the filler sleeve. By this arrangement, the open ends of the sleeve would be closed off thereby preventing the escape of the product from the bag. Frequently however, when inverting the bag, the filler sleeve would develop wrinkles, defining channels to permit the escape of the product from the bag. The unwanted sifting of the product out of the bags would be exacerbated when the bags were handled and shifted during shipment and sale. Accordingly, it would be desirable to provide an improved filler sleeve that was substantially sift proof and inhibits the escape of the granular product from the bag.

Therefore, it is an object of the subject invention to provide a new and improved filler sleeve, for use in conjunction with a bag adapted to hold a product, which is operative to prevent the unwanted escape of the product from the bag.

It is another object of the subject invention to provide a new and improved filler sleeve which substantially reduces the likelihood of side panel blowout from occurring during the filling of the bag.

It is a further object of the subject invention to provide a new and improved filler sleeve for use in conjunction with a bag adapted to contain a product, including an elongated tubular member having a closed end and a slit disposed in the undersurface thereof, the sleeve being operative to deflect the granular material downwardly into the bag to prevent side panel blowout.

It is still another object of the subject invention to provide a new and improved filler sleeve formed from a material which stretches during the pressurized filling of the product, such that the edges of the slit, provided therein, tend to overlap when the bag is inverted thereby preventing the escape of the product from the bag.

SUMMARY OF THE INVENTION

In accordance with these and many other objects, the subject invention provides for a new and improved filler sleeve for use in conjunction with a bag adapted to contain a fibrous, flake, powder or granular product. The bag, which has a generally elongated tubular configuration, includes a closed bottom end and a top end having a filler opening therein. The new and improved filler sleeve, which is preferably formed from a polyethylene or similar material, is generally tubular in configuration and is connected to the top end of the bag. The filler sleeve includes an open end which is contiguous with the filler opening formed in the top end of the bag. The opposed end of the filler sleeve is securely closed. The filler sleeve is further provided with a slit, disposed on the lower surface thereof. Preferably, the slit extends longitudinally, from a point near the closed end of the sleeve to a point intermediate the length thereof. The bag is filled by injecting the product, under pressure, into the filler sleeve through a nozzle. The filler sleeve opens and permits the nozzle to deflect the product downwardly, through the slit into the bag. By this arrangement, the granular product is prevented from directly impinging upon the opposed end wall panel of the bag, thereby substantially reducing the likelihood of end panel blowout.

Another significant advantage of the new and improved filler sleeve of the subject invention is that during the filling operation, the pressure of the granular product on the polyethylene sleeve tends to cause a stretching of the plastic, particularly around the area of the slit. Thus, when the filling is complete and the bag is inverted, the edges of the sleeve adjacent the slit overlap. The weight of the product resting on the sleeve functions to maintain the sides of the slit in an overlapping relationship. By this arrangement, the weight of the product cooperates with the overlapped side edges of the slit to prevent the unwanted escape of the granular product from the bag. In the preferred embodiment of the subject invention, a reinforced backing sheet is provided which is disposed between the top surface of the sleeve and the top panel of the bag. The side edges of the backing sheet are folded into a dual ply configuration along with the side edges of the filler sleeve. By this arrangement, the reinforced backing sheet structurally reinforces the filler sleeve.

These and many other objects will become apparent from the following detailed description taken in conjunction with the drawings in which:

DESCRIPTION OF THE PREFERRED EMBODIMENT

Figure 2:
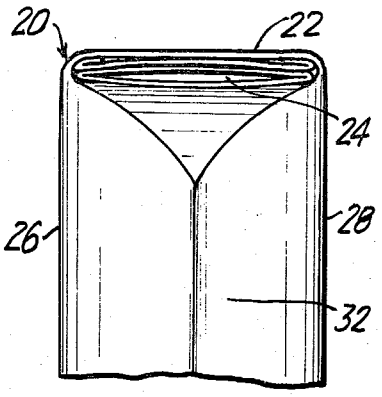
FIG. 2 is a partial, end elevational view of the bag adapted to hold a granular-type product and illustrating the filler opening in the top end thereof.

Referring to FIGS. 1-4, there is illustrated the new and improved filler sleeve 10 of the subject invention which is used in conjunction with a bag 20 adapted to contain a granular-type product. Bag 20, which has a generally elongated tubular configuration, includes a closed bottom end (not shown) and a top end 22 including a filler opening 24. Bag 20 is defined by a pair of opposed side walls 26, 28 and a pair of opposed end wall panels 30 and 32.

Figure 1:
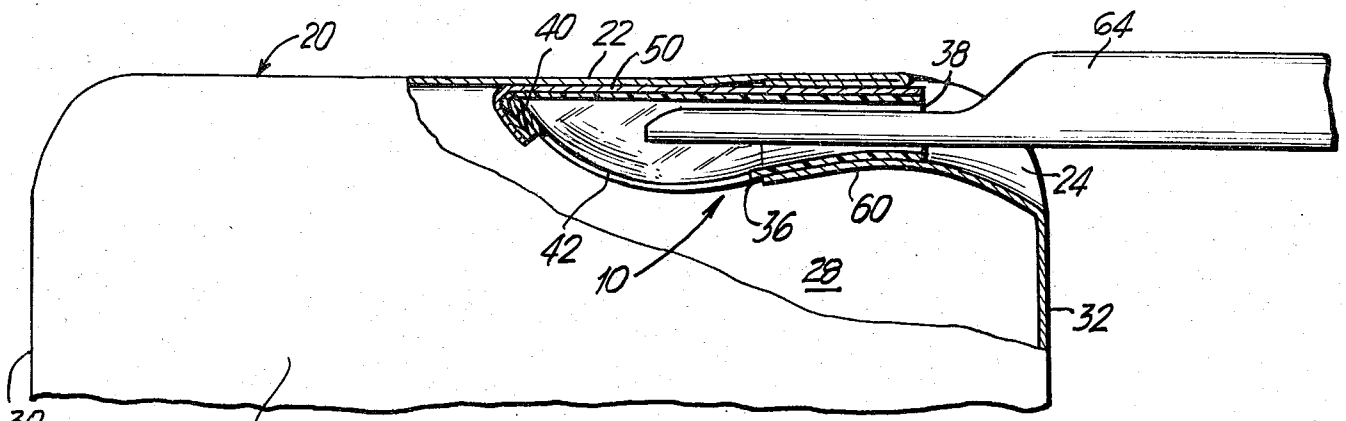
FIG. 1 is a partial cross-sectional view of a bag adapted to hold a granular-type product and illustrating the new and improved filler sleeve of the subject invention showing a nozzle inserted therein prior to filling.

In accordance with the subject invention, the filler sleeve 10 of the subject invention is formed from a generally elongated tubular member 36 which is preferably made from a polyethylene material. The thickness of the polyethylene is on the order of 0.0015 inches. The elongated tubular member 36 includes an open end 38, contiguous with the filler opening 24 of the bag 20, as illustrated in FIG. 1. The opposed end 40 of the tubular member 36 is sealed.

Tubular member 36 is further provided with a slit 42, to permit the introduction of the granular product into the bag through the sleeve. Preferably, slit 42, extends parallel to the longitudinal axis of the tubular member 36, from the closed end 40 to a point intermediate the length thereof.

Figure 3:
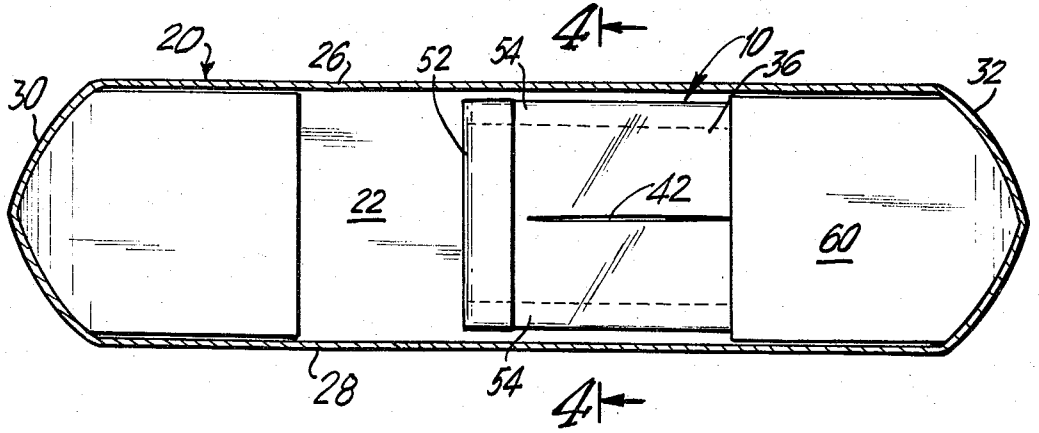
FIG. 3 is a plan sectional view of the top end of the bag shown from the interior thereof, prior to filling, and illustrating the new and improved filler sleeve of the subject invention.

To facilitate the attachment of filler sleeve 10 to the top end 22 of the bag 20, and to provide reinforcement to the sleeve, a backing sheet 50 is provided. Backing sheet 50, which is preferably formed from kraft paper, is adhesively connected to both the tubular member 36 and the inner surface of the top end 22 of the bag. The dimensions of backing sheet 50 are initially greater than the dimensions of the tubular member 36. More particularly, the initial length of back sheet 50 is preferably the same length as tubular member 36. The backing sheet can be folded downwardly into a dual ply configuration, along with the end 40 of the sleeve to define a tuck 52, as illustrated in FIG. 3. The initial width of back sheet 50 is preferably approximately 1½ inches wider than the width of the tubular member 36. The side edges of the sheet 50 may then be folded upwardly into a dual ply configuration, along with the opposed side edges of the sleeve to define a pair of turnover edges 54. The turnover edges 54 cooperate with tuck 52 to reinforce and lock the sleeve thereby inhibiting its rupture during the filling operation. The end 40 of tubular member 36 may be closed by heat sealing instead of folding if desirable.

As illustrated in FIGS. 1 and 3, a secondary support sheet 60 may be provided, which is an extension of end wall 32. Support sheet 60 is adhesively connected to the lower surface of the tubular member 36 for additional reinforcement.

Figure 7:
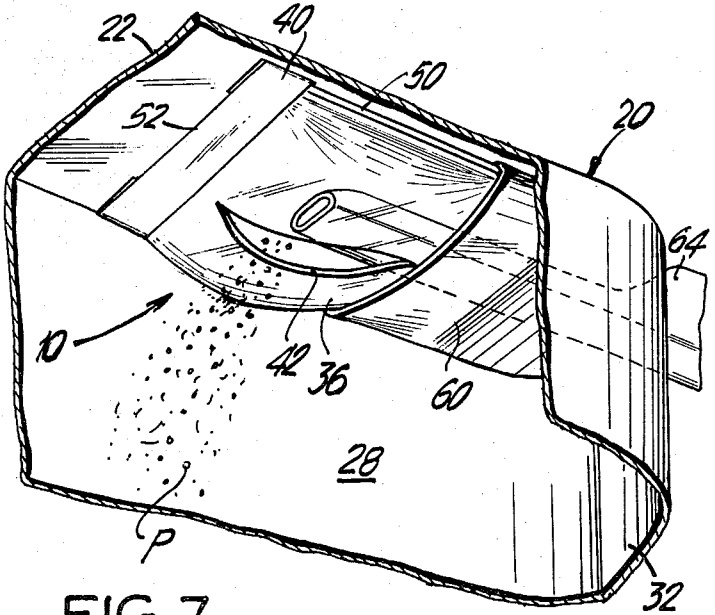
FIG. 7 is a partial perspective view of the bag, with parts cut away, to illustrate the filler sleeve of the subject invention during a filling operation.

Bag 20 is intended to be automatically filled with a granular-type product P under pressure. More specifically, and as illustrated in FIG. 1, bag 20 is oriented in an upright position, such that a jet nozzle 64 can be inserted through filler opening 24 of the bag and into the sleeve 10. Thereafter, a product P is injected under pressure, through nozzle 64 and into the sleeve 10, and downwardly through slit 42 as illustrated in FIG. 7. During the filling operation, the pressure of the product tends to inflate and expand the polyethylene sleeve 10 into a generally tubular configuration. The swirling pressurized product is then deflected downwardly, off the top surface of the nozzle through slit 42 and into the interior of the bag. This facilitates the deflection of the product downwardly into the interior of the bag. The product is thus directed toward the reinforced, closed bottom of the bag (not shown). Since the product is prevented from being channeled directly across the bag, towards end panel 30 as in the prior art, the likelihood of blowout of the end panel is substantially reduced.

Figure 5:
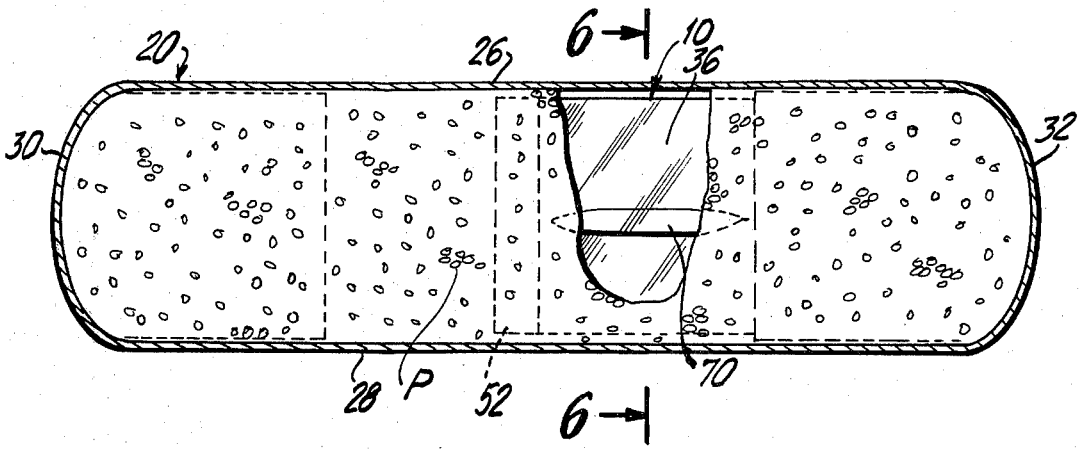
FIG. 5 is a plan sectional view, similar to FIG. 3, of the new and improved sleeve of the subject invention, after the bag has been filled with a granular-type product.
Figure 4:
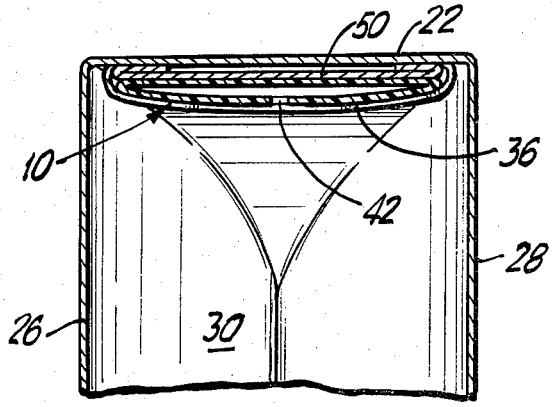
FIG. 4 is a cross-sectional view of the new and improved filler sleeve of the subject invention taken along the line 4—4 in FIG. 3.
Figure 6:
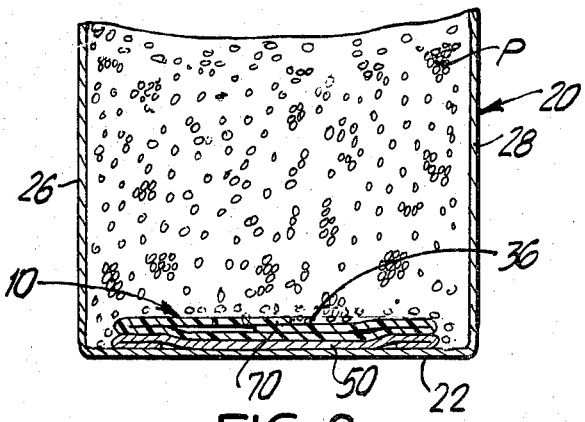
FIG. 6 is a cross-sectional view of the new and improved filler sleeve of the subject invention, taken along line 6—6 of FIG. 5, and illustrating the sealing of the bag after being inverted.

As pointed out above, preferably the tubular sleeve 36 is formed from a polyethylene or similar material. In accordance with the subject invention, the walls of the tubular member 36 will stretch under the force of injection of the product P. Referring to FIGS. 5 and 6, the stretching of the tubular member 36 enhances the complete closure of the sleeve 10 to prevent the unwanted escape of the product out of the bag 20. More specifically, after the bag has been completely filled, the bag is inverted 180°, such that the top end 22 is disposed downwardly. Thus, the weight of the granular product P tends to compress and seal the tubular member 36. Further, since the material forming the tubular member 36 has stretched, the side edges of the slit 42 will overlap, as illustrated at area 70 in FIGS. 5 and 6. The weight of the product P resting on the sleeve 10, maintains the side edges of the slit in overlapping relationship. By this arrangement, the unwanted leakage of the product P out of the bag is substantially prevented.

In summary, there is provided a new and improved filler sleeve for use in conjunction with a bag adapted to contain a product. The bag, which generally has an elongated tubular configuration, includes a closed bottom end and a top end having a filler opening. The filler sleeve is defined by an elongated tubular member which is connected to the top end of the bag and has an open end contiguous with the filler opening of the bag. The opposed end of the filler sleeve is sealed. A longitudinally extending slit is provided in the lower surface of the filler sleeve. During the filling of the bag, the product is introduced through the filler opening into the filler sleeve under pressure. The filler sleeve permits the deflection of the product downwardly, through the slit provided therein and into the bag. By directing the product downwardly, towards the closed bottom end, the likelihood of end panel blowout is reduced. Preferably, the filler sleeve is formed from a stretchable material such that during the filling operation, the side edges of the slit stretch. By this arrangement, when the filling is complete, the bag may be inverted whereby the edges of the slit overlap. The weight of the product functions to maintain the edges of the slit in overlapping relationship thereby preventing the unwanted escape of the product from the bag.

While the subject invention has been described with reference to a preferred embodiment, it is apparent that changes and modifications can be made therein by one skilled in the art without varying from the scope and spirit of the appended claims.

What is claimed is:

1. A filler sleeve for use in conjunction with a bag adapted to contain a granular-type product, said bag having an elongated tubular configuration including top and bottom ends, with the bottom end of said bag being closed and with the top end thereof including a filler opening, said filler sleeve comprising:

an elongated tubular member disposed within said bag and connected to said top end thereof, said tubular member having an open end contiguous with said filler opening in said top end of said bag and with the opposed end of said tubular member being closed, said tubular member further including a slit, disposed on the bottom surface of said tubular member, opposed to the top end of said bag, whereby when said bag is filled by introducing said product, through said filler opening, into said tubular member under pressure, said tubular member permits the deflection of the product downwardly into said bag through said slit, and wherein when the filling of said bag is completed, it may be inverted such that the weight of said product on said tubular member functions to close said slit thereby preventing the unwanted escape of said product from said bag.

2. A filler sleeve as recited in claim 1 wherein said slit in said tubular member extends parallel to the longitudinal axis thereof, from said closed end to a point intermediate the length thereof.

3. A filler sleeve as recited in claim 1 wherein said tubular member is formed from a stretchable material such that during the pressurized filling of said bag, said material stretches whereby when said filling is completed and said bag is inverted, the portions of said tubular member defining said slit overlap to prevent the unwanted escape of said product from said bag.

4. A filler sleeve as recited in claim 3 wherein said tubular member is formed from polyethylene.

5. A filler sleeve as recited in claim 4 wherein the thickness of the polyethylene, forming said tubular member, is about 0.0015 inches.

6. A filler sleeve as recited in claim 1 further including a reinforcing backing member adhesively connected to the top surface of said tubular member.

7. A filler sleeve as recited in claim 6 wherein said reinforcing backing member is further connected to the inner top surface of said bag.

8. A filler sleeve as recited in claim 6 wherein the end of said reinforcing backing member, adjacent said closed end of said tubular member, is folded into a dual ply configuration along with said tubular member, whereby said closed end of said tubular member is structurally reinforced.

9. A filler sleeve as recited in claim 8 wherein the side edges of said reinforcing backing paper, adjacent the side edges of said tubular member, are folded into a dual ply configuration to provide added reinforcement.

10. A filler sleeve for use in conjunction with a bag adapted to contain a granular-type product, said bag having an elongated tubular configuration including top and bottom ends, with the bottom end of said bag being closed and with the top end thereof including a filler opening, said filler sleeve comprising:

and elongated tubular member formed from a stretchable material, said tubular member being disposed within said bag and connected to the top end thereof, said tubular member having an open end contiguous with said filler opening in said top end of said bag, and with the opposed end of said tubular member being closed, said tubular member further including a longitudinally extending slit running from said closed end of said tubular member to a point intermediate the length thereof, said slit being disposed on the bottom surface of said tubular member opposed to the top end of said bag, whereby when said bag is filled by introducing said products, through said filler opening into said tubular member under pressure, said tubular member stretches, and simultaneously permits the deflection of the product downwardly into said bag through said slit, and wherein when the filling of said bag is completed, the bag may be inverted such that the portions of said tubular member defining said slit overlap and the weight of said product on said tubular member functions to securely close said slit thereby preventing unwanted escape of said product from said bag.

11. A filler sleeve as recited in claim 10 wherein said tubular member is formed from polyethylene.

12. A filler sleeve as recited in claim 10 further including a reinforcing backing member adhesively connected to the top surface of said tubular member, said reinforcing backing member being further connected to the inner top surface of said bag.

13. A filler sleeve as recited in claim 12 wherein the end of said reinforcing backing member, adjacent said closed end of said tubular member, is folded into a dual ply configuration along with said tubular member whereby said closed end of said tubular member is structurally reinforced.

14. A filler sleeve as recited in claim 13 wherein the side edges of reinforcing backing paper, adjacent the side edges of said tubular member, are folded into a dual ply configuration to provide added reinforcement.

* * * * *